United States Patent [19]

Southard

[11] 3,954,039

[45] May 4, 1976

[54] CHORD SELECTION SYSTEM FOR A MUSICAL INSTRUMENT

[75] Inventor: James S. Southard, Union, Mich.

[73] Assignee: C. G. Conn, Ltd., Elkhart, Ind.

[22] Filed: Jan. 30, 1975

[21] Appl. No.: 545,355

[52] U.S. Cl. ..... 84/1.01; 84/DIG. 7; 84/DIG. 22

[51] Int. Cl.[2] ..... G10H 1/00; G10H 5/02

[58] Field of Search ..... 84/1.01, 1.03, 1.11, 84/1.13, 1.17, 1.24–1.26, DIG. 7, DIG. 8, DIG. 12, DIG. 22

[56] References Cited

UNITED STATES PATENTS

| | | | |
|---|---|---|---|
| 3,557,295 | 1/1971 | Adachi | 84/1.19 X |
| 3,570,357 | 3/1971 | Adachi | 84/1.26 |
| 3,590,129 | 6/1971 | Freeman | 81/1.01 |
| 3,598,892 | 8/1971 | Yamashita | 84/1.01 |
| 3,609,203 | 9/1971 | Adachi | 84/1.01 |
| 3,673,303 | 6/1972 | Amano | 84/1.01 |
| 3,708,604 | 11/1971 | Hebeisen et al. | 84/1.03 |
| 3,762,265 | 10/1973 | Adachi | 84/1.24 |
| 3,828,110 | 8/1974 | Colin | 84/1.01 |
| 3,844,192 | 10/1974 | Brand et al. | 84/1.01 |
| 3,845,683 | 11/1974 | Lehmann | 84/1.01 |
| 3,871,262 | 3/1975 | Robinson et al. | 84/1.17 |
| 3,872,765 | 3/1975 | Amaya | 84/1.01 |
| 3,889,568 | 6/1975 | Amaya | 84/1.01 |

*Primary Examiner*—L. T. Hix
*Assistant Examiner*—Stanley J. Witkowski
*Attorney, Agent, or Firm*—LaValle D. Ptak

[57] ABSTRACT

A keyboard electronic musical instrument includes a plurality of playing keys, each of which are capable of coupling a set of chord tone signals to an output utilization circuit. These chord tone signals comprise the root and fifth parts and also the major third and minor third parts of a chord. Each of the playing keys are capable of operation to two different depressed positions, one of which causes the major third chord component to be supplied along with the root and fifth parts to the utilization device. The other depressed position of the key causes the minor third chord component to be supplied along with the root and fifth parts to the utilization device. Provision also is made for permitting only the root note tone signal to be passed to the output circuit to permit normal playing of the keyboard.

8 Claims, 8 Drawing Figures

OUTPUT CIRCUIT
BASS SIGNAL
MAJOR/MINOR SWITCHING
MAJOR 3RD SWITCH
MAJOR 3RD SWITCH
TONE SIGNAL GENERATORS
SECOND TOUCH KEYING
MINOR THIRD ROD
MAJOR THIRD ROD
FIFTH ROD
ROOT ROD
SECOND TOUCH ROD

CHORD SELECTION SYSTEM FOR A MUSICAL INSTRUMENT

BACKGROUND OF THE INVENTION

In the development of electronic musical instruments, such as electronic organs, chord selection systems have been developed which permit the musician to form chords from the keyboard or accompaniment manual by depressing a single key representative of the root note of the desired chord. Additional circuitry in the organ has been provided to provide alternate application of the chord parts to the output transducers of the organ or to provide a rhythmic application of the chord in accordance with preset controls on the organ. While chord playing systems of this type have met with wide commerical acceptance, the pre-programmed chord parts limit the number of musical keys which can be played by the musician to those imposed in the original design of the organ. More accomplished musicians who might wish to take advantage of the extended capabilities which are made possible by such one-note chord producing systems may find it difficult to work within the limitations imposed, which generally permit the playing of only major chord triads when the instrument is placed in its automatic chord or one-note chord mode of operation.

Some prior art organs increased the flexibility available to a musician in such one-note chord systems, by causing the depression of the root note key to simultaneously initiate operation of or couple tone generators for the fifth parts and the major and minor third parts of a chord. An additional switch then is provided to select either the minor third or the major third part for ultimate reproduction along with the root and fifth parts in an output transducer. In some cases, this switch is a separate manual switch which may be foot operated, knee operated, or operated in the manner of the control tabs of the organ. In one position of the switch, major chords are produced; in a different position of the switch, minor chords are produced. While this does increase the flexibility of the instrument, it is necessary for the musician to operate this additional switch whenever he wants to make a change from a minor chord to a major chord or vice-versa. To a beginning musician, the imposition of this additional requirement of operating such a switch tends to complicate the playing of the instrument.

In order to expand the flexibility of one-note chord producing systems, a prior art system has been developed in which the musician can preselect the key which is to be played. Once this has been done, depression of any of the root note playing keys which generate the chords, then causes either a major chord or a minor chord to be produced in accordance with a pre-established relationship of the note produced by the playing key to the musical key selected in advance. Some of the root notes played in an octave then will produce major chords, and others will produce minor chords in accordance with the pre-established musical key.

While this type of system does provide increased flexibility to the musician, there still is imposed upon the musician an unnecessary constraint which makes it difficult for him to make major chord to minor chord transpositions at will. In fact, the musician in such a system has no control over the particular chord produced by depression of a playing key. If he wishes to make a major chord to minor chord transposition with respect to any particular playing key, it also is necessary for him to know which musical key he must select to effect this transposition. Then he must operate a separate switch to select the musical key which will give him the result he desires.

It is desirable to provide in an electronic organ a chord playing system which permits the musician to play a single note, the root note, for the chord, with the rest of the chord being automatically produced; but which gives the musician control over whether the chord produced is a major or minor chord without requiring him to operate additional switches with his feet, knees, or hands.

SUMMARY OF THE INVENTION

It is an object of this invention to provide an improved electronic musical instrument.

It is another object of this invention to provide an improved chord-producing system for an electronic organ.

It is a further object of this invention to provide an electronic organ having at least some playing keys which are capable of giving a secondary form of control to organ functions in addition to the generation of the normal tone signals associated with such keys.

It is yet another object of this invention to provide a simplified chord-producing system for an electronic organ capable of major/minor chord switching at the will of the musician.

It is a still further object of this invention to provide major/minor chord selection from a playing key capable of operation to first and second depressed positions, with the key producing one of the major/minor chords in the first position and producing the other of the major/minor chords in the second position.

In accordance with the preferred embodiment of this invention, an electronic organ includes a tone generator and at least one playing key which is capable of movement from a rest position to at least first and second operated positions. In the first operated position, switches on the key close on at least one bus-bar to supply at least the root tone signal represented by the key to a utilization circuit. When the key is depressed to its second operated position, a second switch is closed to a different bus-bar to control an operating function of the organ other than that provided by the key moved to its first operated position.

In a more specific embodiment, movement of the playing key to its first position couples the tone generators for the root note, the fifth part of a chord and the major third and minor third chord parts to an output circuit for coupling with a utilization circuit. An electronic switch circuit operates to block one of the major or minor chord components and to pass the other, so that a chord triad representative of such other of these components is supplied to the utilization circuit. When the key is depressed to its second operated position, an additional key switch is closed, which causes the electronic switch to reverse state and to cause the one of the major/minor chord components to be supplied to the utilization circuit and the component which previously was passed now is blocked. Thus a major/minor chord shift is effected.

DETAILED DESCRIPTION

The same reference numbers are used throughout the several figures to denote the same or similar components.

Figure 1:
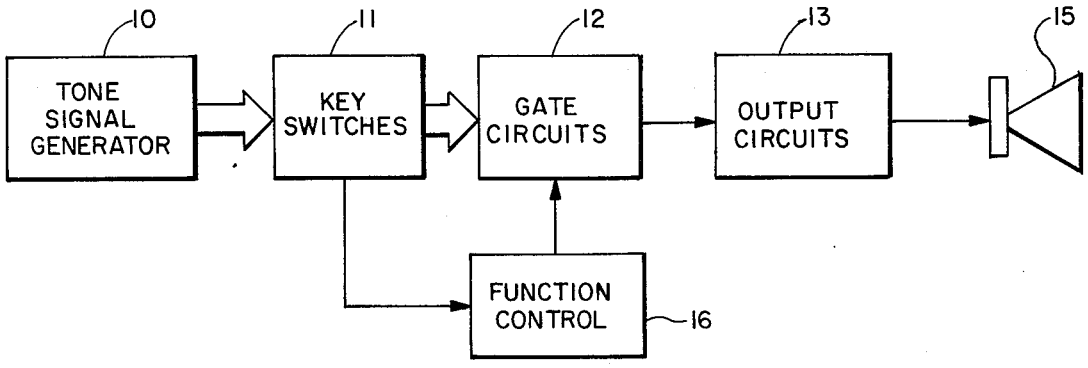
FIG. 1 is a block diagram illustrating the operation of an embodiment of the invention.

Referring now to FIG. 1, there is shown a simplified block diagram of an electronic organ illustrating the manner in which the system of a preferred embodiment of this invention may be utilized in conjunction with other components of the organ to produce the desired effects. In FIG. 1, a tone signal generator circuit 10 is used to produce the full range of different tones which are to be reproduced by the organ. The tones may be continuously supplied on individual leads from the output of the tone signal generator or may be produced by individually activated generators in response to the operation of key switches in a key switch circuit 11, the switches of which in turn are controlled by the playing keys of the instrument. In the circuit shown in FIG. 1, assume that the different tone signals from the generators 10 are continuously individually applied to different key switches 11 for the different playing keys.

Whenever a playing key is depressed or operated, it closes one or more of the key switches 11 to pass one or more tones from the tone signal generator 10 to gate circuits 12. In the playing of conventional single notes from a selected playing key, the gate circuits 12 merely pass the tone represented by that note to the output circuit 13, which includes conventional voicing and stop controls and amplifiers commonly employed in an electronic organ. The output circuit 13 then supplies the tones, as modified by the voicing and control circuits, to a loudspeaker 15 where the tones are reproduced to represent the operation of the playing keys which operated the key switches 11.

In many electronic organs, a provision is made for the accompaniment playing keys to close key switches representative of chords, such as the major or minor third chord triads, and to simultaneously supply tones representative of these chords to the gate circuits 12. To determine whether the chord passed by the gate circuits 12 is a major or minor chord, or has some other chordal components, a function control circuit 16 responds to closure of selected ones of the key switches to selectively enable and block various ones of the gate circuits 12 to pass the tones representative of the desired chordal effect which is to be produced.

Figure 2:
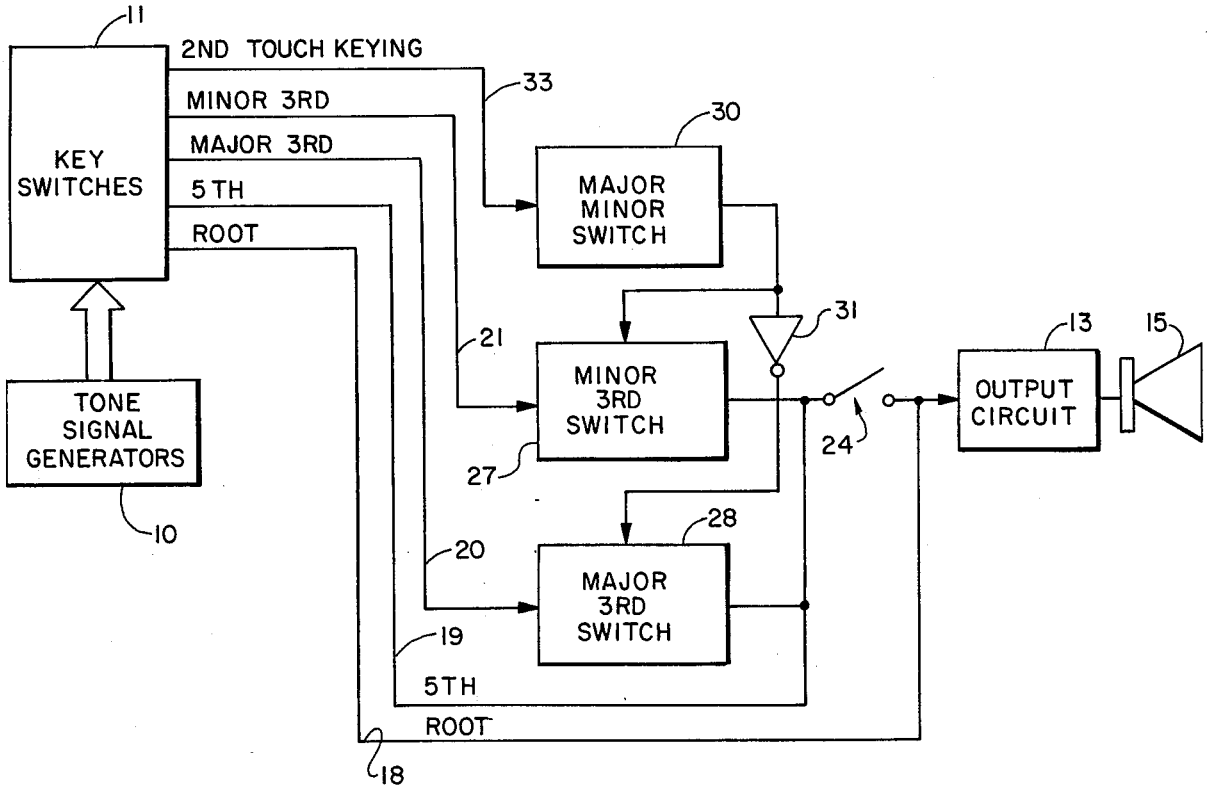
FIG. 2 is a block diagram of a preferred embodiment of the invention.

Referring now to FIG. 2, there is shown a more specific block diagram of the system for accomplishing the passage of major or minor chords to the output circuit 13 in accordance with the manner of operation of the key switches 11. As shown in FIG. 2, assume that depression of a playing key for any of the key switches 11 to a first operated position causes it to supply the root note represented by that playing key, the fifth chordal component, and both the major third and minor third chordal components to the output leads 18, 19, 20 and 21, respectively. Of course, the actual tones applied to these leads will differ for each of the different playing keys which operate the key switches 11, but the chordal components are interrelated for each of the different root note tones produced on the lead 18.

The root note tone is applied directly to the output circuit 13; so that it is always reproduced irrespective of the manner of operation of a "one finger chord" switch 24. When the switch 24 is open, only the root note tone is supplied to the output circuit 13. When the switch 24 is closed, however, both the root note tone and fifth chordal tone component on the lead 19 are connected directly to the outputs of the circuit 13.

The minor third tone and the major third tone are supplied, respectively, to a minor third switch 27 and a major third switch 28. These switches operate as gates to either block or pass the tones applied to their respective inputs. A major/minor switch 30 is used to control which of the gates 27 or 28 passes a tone to its output. The output of the switch 30 is applied directly to a control input of the minor third switch 27 and is inverted by an inverter 31 and applied to a control input of the major third switch 28.

For normal playing or operation of the key switches 11, the major/minor switch 30 supplies an output which enables the major third switch 28 to pass the major third tone to its output and inhibits the minor switch 27. Thus, normally a major third chordal triad is supplied to the output circuit 13 when the switch 24 is closed.

In accordance with a preferred embodiment of this invention, however, the playing keys are capable of operation to a second position which produces an output on a second touch keying lead 33 to change the state of operation of the major/minor switch 30. When this occurs, the minor third chord components are passed by the minor third switch gate 27, and the major third chord components are blocked by the major third switch gate 28. Thus, it is possible for the musician to play either a major third chord or a minor third chord for any root note provided with this "one-finger" chord option merely by depressing the playing key to its normal playing position to produce the major third chord or by depressing the key further to a second touch position to produce the minor third chord. The production of the major or minor third chord is solely at the discretion of the musician based upon the manner in which he presses the playing key for the root note.

Figure 3:
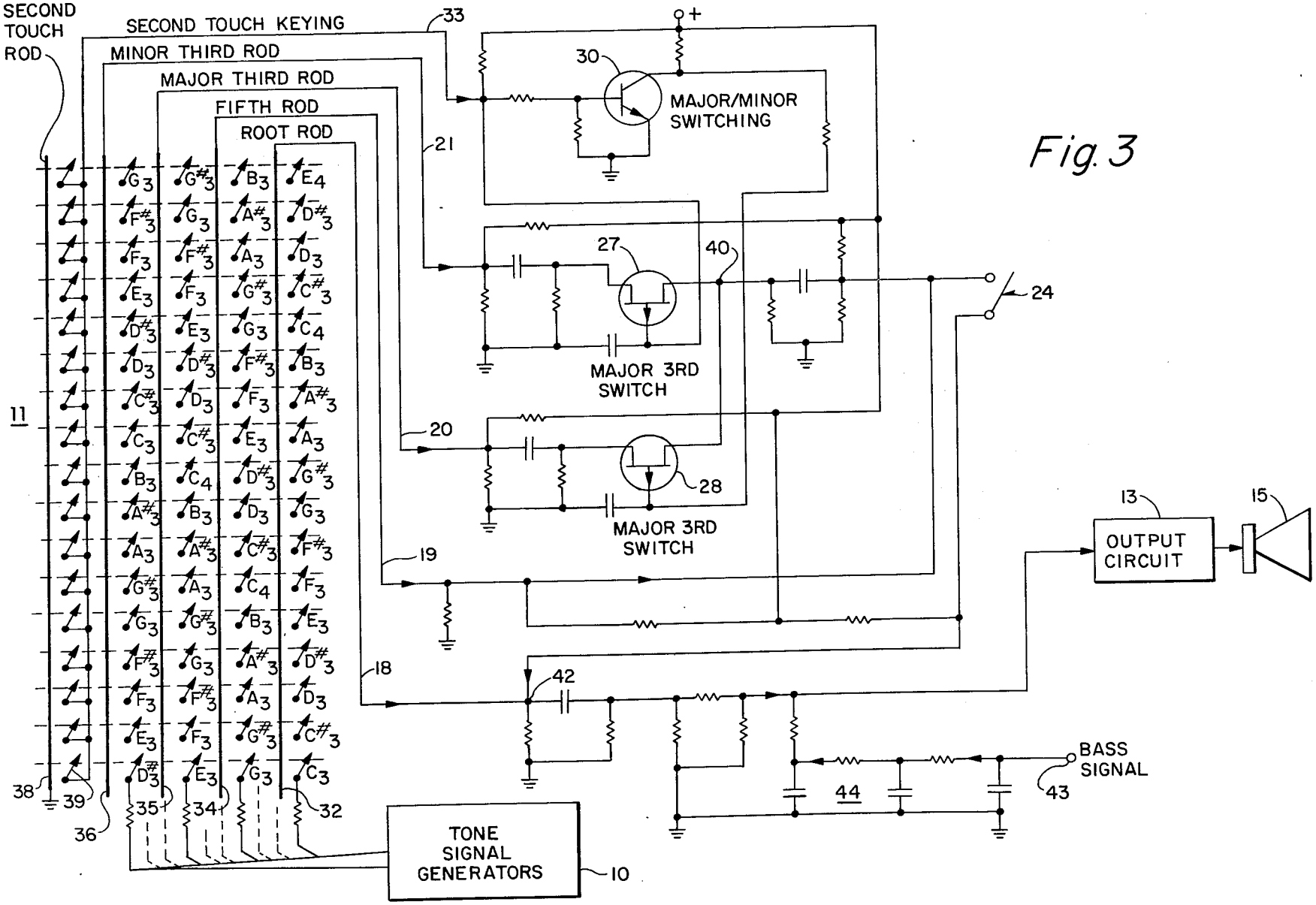
FIG. 3 is a circuit diagram, partially in block form showing additional details of the circuit of FIG. 2.

Referring now to FIG. 3, there is shown a detailed schematic diagram of the circuit illustrated in block form in FIG. 2. In FIG. 3, outputs from the tone generators 10 are shown connected to the root note C3, its associated fifth chordal component G3, major third chordal component E3 and minor third chordal component D # 3. Corresponding connections from the tone generators 10 are made to all of the key switches 11 for the playing keys of the organ which are provided with the capability of producing one-finger chording upon their actuation. In order to avoid cluttering the drawing with unnecessary wiring, however, the connections from the tone signal generators 10 to the other key switches 11 shown in FIG. 3, are not shown. These connections, however, are similar to those shown for the bottom key switches associated with root note C3.

One-finger chording is generally only desired with the left-hand or accompaniment keyboard and generally encompasses an octave or one and one-half octaves in range. As shown in FIG. 3, a typical range extends from root note C3 to root note E4, as can be ascertained from the labeling of the key switches 11 in FIG. 3. All of the key switches 11 which are actuated by a single playing key are shown as interconnected by a dotted line. Each of the playing keys is capable of operation from a rest position to a first or normal operated position where the key switches for the parallel key rod buses 32, 34, 35, and 36, connected respectively to the output leads 18, 19, 20 and 21 for the root note, fifth, major third, and minor third tones, are simultaneously engaged by the key switches shown as thus interconnected.

For example, assume that the playing key for root note C3 is depressed to its first position. This causes the key switches C3, G3, E3, and D #3 on the bottom row of the key switch assembly in FIG. 3 to simultaneously engage the buses or rods 32, 34, 35, and 36, respectively. The tones for those four notes then are supplied to the respective leads 18, 19, 20 and 21.

At this time, a fifth key switch 39 for the playing key for root note C3, however, is not closed to the rod 38, which is the second touch rod for the playing key. As a consequence, the potential on the base of a major/minor NPN switching transistor 30 remains at a positive potential causing the transistor 30 to be conductive. When the transistor 30 conducts, it applies a near ground potential to the gate of a major third switching P-channel FET transistor 28 to cause the transistor 28 to be conductive to pass the major third tones on the lead 20 through an AC coupling capacitor and the drainsource path of the transistor 28 to an output terminal 40. At the same time, a P-channel FET transistor 27 is nonconductive, due to the relatively high potential applied to its gate on the lead 33; so that the minor third tones are blocked.

If the switch 24 also is closed at this time, the fifth chordal components, along with the major third chordal components are passed through the switch 24 and applied in common at a junction 42 with the root note tone for application through an AC coupling capacitor to the output circuit 13. Isolating resistors prevent direct coupling of the tones on the lead 19 to the junction 41 when the switch 24 is open.

Additional signals, such as a bass signal, can be applied to an input terminal 43 where they are voiced by a low pass network 44 and combined with the signals applied to the terminal 42. Other modifications can be made to the composite input to the circuit 13 from the terminal 42, such as a rhythm pulse modulation or the like if this is desired.

Now assume that the same playing key is still depressed, but is further depressed to a second touch position to close the key switch 39 to the grounded second touch rod 38. This applies a ground potential on the lead 33 to the base of the transistor 39 and to the gate of the field-effect transistor 27. The field-effect transistor 27 is then turned on and the transistor 30 is turned off which, in turn, turns off the transistor 28. As a consequence, the minor third tones now are passed through a coupling capacitor and the FET transistor switch gate 27 to the terminal 40; and the major third tones on the lead 20 are blocked by the now nonconductive FET major third transistor switch gate 28. In all other respects, the system operates in the same manner described previously.

The foregoing operation takes effect for the depression of a playing key associated with any of the different root notes of the key switches 11 illustrated on the left-hand side of FIG. 3, providing maximum flexibility to the musician for the selection of either a major or a minor chord depending upon whether he depresses the playing key beyond its first position to a second touch position or not. When the switch 24 is open, only the root note tone is supplied on the lead 18 to the terminal 42; so that the accompaniment section of the organ also can be played in a normal manner.

Reference to FIGS. 2 and 3 also shows that it is possible to interpose additional switch controls between the outputs of the major and minor third switches 28 and in the lead 19 for the fifth parts of the chord to provide different effects even when the switch 24 is closed. For example, if the organ is used to produce bagpipe effects, it is desirable to block the application of both the major third and minor third tones. This can be accomplished by the insertion of a single-pole, single-throw switch in the output leads from each of the minor third and major third switches 27 and 28, while still permitting the fifth parts to be applied through the switch 24 to the output circuit 13. Other variations are also possible.

Figure 4:
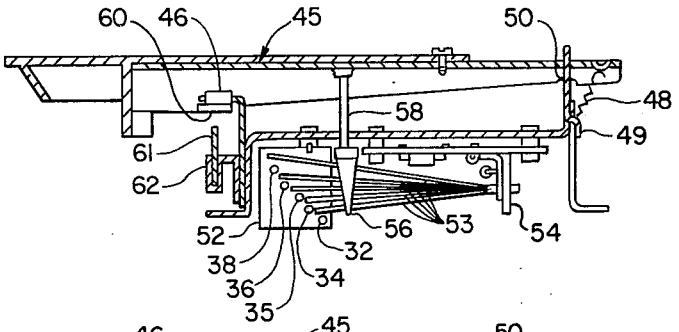
FIGS. 4, 5 and 6 are cross-sectional views showing a playing key in different operating positions to effect the operation of the circuit illustrated in FIGS. 2 and 3.
Figure 5:
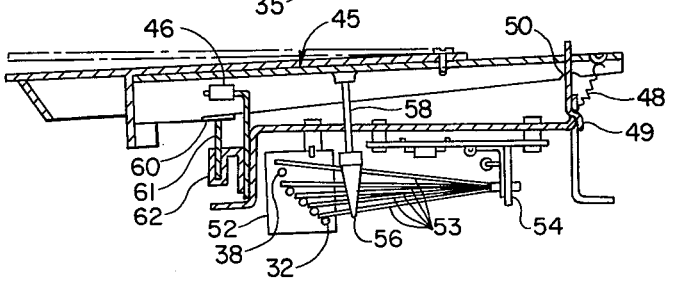
Figure 6:
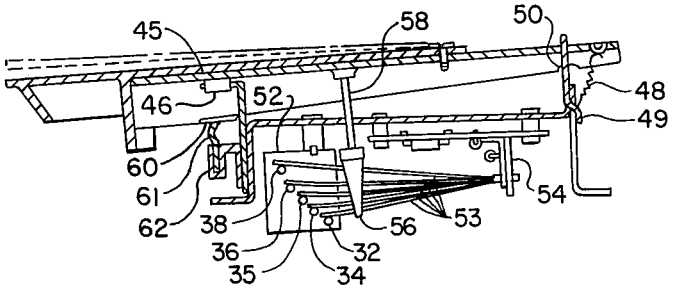

Referring now to FIGS. 4 through 8, there is shown a playing key arrangement having a second touch provision which is suitable for operating the key switches illustrated in detail in FIG. 3. Such a second touch keyboard is disclosed in U.S. Pat. No. 3,845,683 to Alfred H. Lehmann, issued Nov. 5, 1974, and the disclosure of that patent is incorporated herein by reference. Each of the playing keys associated with the root notes identified in FIG. 3 has a structure such as illustrated in FIGS. 4, 5 and 6. These three figures show the playing key in a rest position in FIG. 4, in a first or normal operated position in FIG. 5, and depressed downwardly to a second operated position, the second touch position, in FIG. 6.

Each of the keys in this section of the keyboard comprises a pivotally mounted playing key 45 which is biased upwardly against a stop 46 under the action of a spring 48 connected to a vertical portion 49 of the keybed. The rear of each key 45 is biased by the spring 48 to pivot the right-hand end of the key 45, as viewed in FIGS. 4, 5 and 6, in a clockwise direction about a pivot portion in the keybed which is engaged by notches 50 in the channel of the key 45. Mounted beneath the keys and fixed to the frame of the keyboard are insulating blocks 52 which support the fixed conducting rods or buses 32, 34, 35, 36 and 38, illustrated in FIG. 3. These rods are located to be respectively engaged by five resilient conductors 53 when the playing key 45 is depressed or operated. The conductors 53 extend in a direction substantially parallel to the key 45 and are connected to an insulating circuit board 54 which may carry wiring on it to connect the respective conductors 53 which engage the rods 32, 34, 35 and 36 with the appropriate outputs of the tone signal generators 10. The conductors 53 for engaging the rod 38 are connected in parallel to the lead 33 (FIG. 3).

The resilient conductors 53 extend through openings in an insulating actuator 56 which is secured to the key 45 by a stud 58 extending downwardly from the key channel of the key 45. As the actuator 56 moves downwardly, it moves the resilient conductors 53 downwardly into engagement with the transversely extending rods 32, 34, 35 and 36 as illustrated in FIG. 5. The resilient conductors 53 are permitted to slide freely within openings in the actuator 56; so that no tension is placed on the conductors and they are capable of the large number of movements required of the switch for use in an electronic organ keyboard.

As shown in FIG. 5, when the key 45 is depressed to its first operated position, the upper resilient conductor 53 does not make an electrical connection with the rod 38; so that this comprises an open circuit, even though all of the other resilient conductors 53 do make electrical connections with the rods 32, 34, 35 and 36, respectively. With the key depressed to the position in FIG. 5, an extension 60 on the flange of the key channel which limits the upward movement of the key where it engages the stop 46, now engages an upstanding flat resilient member 61 to limit the downward movement of the key. The member 61 forms a wall which is supported in a channel-like support 62 secured to the front of the keybed, along with the stop member 46.

The resilient stop 61 may be made of a material which can be flexed to permit further downward movement of a key 45 which engages this stop, as shown in FIG. 6. This is the second operated position of the key 45 or its "second touch" position. In FIG. 6, the unoperated position of the key as shown by dot-dash lines and the operated position at which the extension 60 on the key channel engages the stop 61 is shown by dashed lines, both of these positions being above the second touch position shown in FIG. 6.

In the position shown in FIG. 6, the key 45 is moved downwardly until the underside of the upper surface of the key 45 engages the resilient stop 46 which forms a limit to further downward movement of the key. However, as the key moves from the position shown in FIG. 5 to the position shown in FIG. 6, the actuator 56 moves the resilient conductors 53 further downwardly; so that the upper conductor 53 now makes an electrical contact with the rod 38. This represents the closures of the switch 39 of FIG. 3 to the rod 38 to complete a connection between ground and the lead 33, as shown in FIG. 3. The resilient conductors 53 which engaged the rods 32, 34, 35 and 36 in FIG. 5 continue to engage those rods in the position shown in FIG. 6, merely being bent or flexed to a greater extent.

Figure 7:
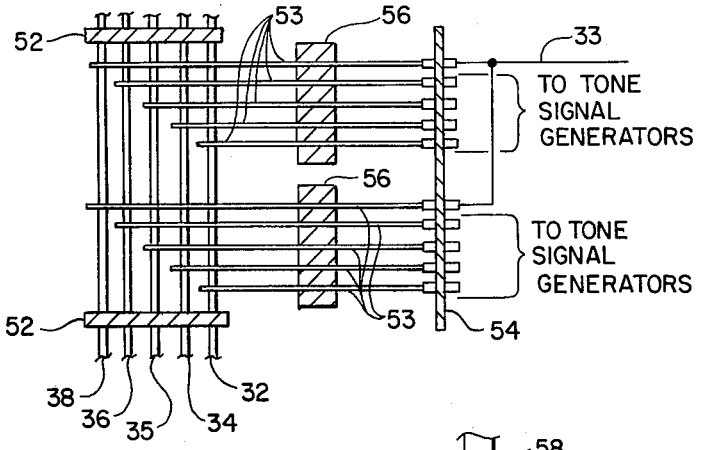
FIG. 7 is a view along line 7—7 of FIG. 6 and shows the switch conductors of FIG. 6.
Figure 8:
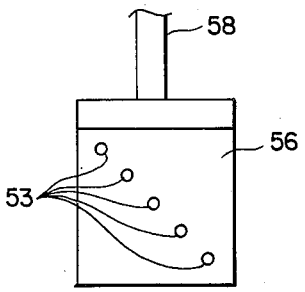
FIG. 8 shows the actuator for the switch conductors.

FIGS. 7 and 8 show the structure of the resilient conductors 53 and the rods 32, 34, 35, 36 and 38 along with the supports and the actuators for them. As previously stated, the resilient conductors 53 are permitted to slide within openings in the actuators 56; so that there is no tension on the conductors 53.

Other forms of switch arrangements or playing keys having a second touch or two position operation may be employed in conjunction with the circuit shown in FIG. 3 to produce the functional operation which has been described. The key 45 with the second touch switching arrangement illustrated in FIGS. 4 through 8 merely serves as an example of the type of second touch playing key and switch arrangement which can be used.

It should be noted that while the system is particularly attractive to permit a musician to produce major or minor chords at will from any playing key having a one-finger chord reproducing capability, the second touch switching feature also may be utilized to produce other effects or controls in the organ.

I claim:

1. In an electronic organ, at least one playing key corresponding to a predetermined root note tone to be produced by said organ, said playing key capable of movement from a rest position to at least first and second different operated positions;

a utilization circuit for processing tone signals applied thereto;

tone signal generating means for generating a plurality of tones;

a plurality of first switch means coupled with said tone signal generating means and responsive to movement of said playing key to the first operated position thereof for supplying a unique plurality of tone signals from said tone signal generating means to said utilization circuit;

gating circuit means coupled with at least some of said first switch means for controlling the application of tone signals therefrom to said utilization circuit; and second switch means coupled with said gating circuit means and responsive to movement of said playing key to the second operated position thereof for selectively controlling the operation of said gating circuit means to thereby control the application of tones therethrough from said first switch means to said utilization circuit.

2. An electronic organ according to claim 1 further including a sequence of playing keys encompassing at least an octave of musical notes and each capable of operation from a rest position to at least first and second operated positions; and wherein said first switch means responds to movement of one of said playing keys to the first operated position thereof to supply a root note tone signal and at least a first other note tone signal from said tone signal generating means to said utilization circuit; and said second switch means responds to movement of said one of said playing keys to the second operated position thereof to supply said root note tone signal and at least a second other note tone signal from said signal generating means to said utilization circuit.

3. The combination according to claim 1 wherein said first and second other note tone signals comprise chord components of major and minor musical chords, selection of one of said first and second other note tone signals causing said chord to be a major chord and selection of the other of said first and second other note tone signals causing said musical chord to be a minor chord.

4. The combination according to claim 3 wherein said first other note tone signal comprises the major third component of a major chord and further including means coupled with said first switch means for producing a fifth chord tone component corresponding with a root note tone represented by said operated playing key.

5. An electronic organ including in combination:

tone generator means capable of producing at least one octave of root note tones, fifth chordal components and major and minor third chordal components for such root note tones;

a plurality of playing keys encompassing at least an octave of musical tones representing the root note tones produced by said tone generator means, each of said playing keys being capable of movement from a rest position to at least first and second operated positions;

an output transducer;

a plurality of first switch means closed by operation of a playing key to said first operated position thereof for coupling corresponding outputs from said tone signal generator representing said root, fifth, minor third and major third chord tone components to different corresponding output leads;

means coupling said fifth and root output leads with said output transducer;

first and second gating circuit means coupling said major third and minor third output leads, respectively, with said output transducer;

second switch means operated from a first state to a second state by operation of a playing key to said second operated position thereof; and means coupled with said second switch means and with said first and second gating circuit means for enabling one of said first and second gating circuit means and for disabling the other with said second switch means in the first state thereof, and for enabling the other of said first and second gating circuit means and for disabling the one with said switch means in the second state thereof, said enabled gating circuit means connecting the chord tone component lead coupled to it to said output transducer.

6. The combination according to claim 5 wherein movement of a playing key to said first operated position causes said first gating circuit means to be enabled to pass the major third chord tone component applied to its input to said output transducer, and with said second gating circuit means being disabled, and movement of a playing key to said second operated position thereof causes said second gating circuit means to be enabled and said first gating circuit means to be disabled, causing said minor third chord tone component to be supplied to said output transducer.

7. The combination according to claim 6 further including additional switch means coupled with said fifth chord tone component output lead and the outputs of said first and second gating circuit means for selectively passing or blocking the application of said fifth chord tone component and the outputs of said major and minor gate circuit means to said output transducer irrespective of the operated position of said playing keys.

8. The combination according to claim 7 wherein said additional switch means is a normally-open switch blocking the application of said fifth chord tone component and the outputs of said first and second gating circuit means to said output transducer, such tone components being passed to said output transducer with said additional switch means being closed, and further wherein said root note output lead is coupled with said output transducer at all times, shunting said additional switch means.

* * * * *